US008256366B2

(12) United States Patent
Imel et al.

(10) Patent No.: US 8,256,366 B2
(45) Date of Patent: Sep. 4, 2012

(54) SMALL WATERCRAFT BOATLIFT

(75) Inventors: Dustin Imel, Rocky Comfort, MO (US); David J Sturtevant, Caro, MI (US)

(73) Assignee: E-Z-Dock, Inc., Monett, MO (US)

( * ) Notice: Subject to any disclaimer, the term of this patent is extended or adjusted under 35 U.S.C. 154(b) by 201 days.

(21) Appl. No.: 12/557,278

(22) Filed: Sep. 10, 2009

(65) Prior Publication Data

US 2010/0067985 A1 Mar. 18, 2010

Related U.S. Application Data

(60) Provisional application No. 61/192,142, filed on Sep. 16, 2008.

(51) Int. Cl.
*B63B 17/00* (2006.01)
*B63C 1/02* (2006.01)

(52) U.S. Cl. ..... 114/263; 114/45; 114/362; 405/1

(58) Field of Classification Search ..... 405/1–3; 114/45, 48, 258, 263, 362
See application file for complete search history.

(56) References Cited

U.S. PATENT DOCUMENTS

| | | | | |
|---|---|---|---|---|
| 5,281,055 | A | 1/1994 | Neitzke | |
| 6,006,687 | A * | 12/1999 | Hillman et al. | 114/46 |
| 6,840,188 | B1 * | 1/2005 | Witbeck | 114/258 |
| 7,100,527 | B2 * | 9/2006 | Munro | 114/230.15 |
| 7,243,608 | B2 | 7/2007 | Knight, Jr. | |
| 7,293,522 | B1 * | 11/2007 | Elson | 114/263 |
| 2005/0172876 | A1 * | 8/2005 | Ostreng et al. | 114/45 |
| 2006/0272566 | A1 * | 12/2006 | Rueckert | 114/263 |
| 2009/0044739 | A1 | 2/2009 | Imel | |
| 2009/0044740 | A1 | 2/2009 | Imel | |
| 2009/0145345 | A1 * | 6/2009 | Newcomb | 114/248 |

* cited by examiner

*Primary Examiner* — Sunil Singh
(74) *Attorney, Agent, or Firm* — Polster, Lieder, Woodruff & Lucchesi, L.C.

(57) ABSTRACT

A boatlift for use with small, manual or paddle or oar powered watercraft (such as canoes and kayaks) is provided with a guide rails on either side of the boat lift, which can be utilized by a boater to propel or urge his/her watercraft onto the boatlift. In addition, that boatlift is provided with an entrance/exit assist member which can be used by boaters with impaired leg function to enter and exit from the watercraft.

18 Claims, 4 Drawing Sheets

SMALL WATERCRAFT BOATLIFT

CROSS-REFERENCE TO RELATED APPLICATIONS

This application claims priority to U.S. Provisional Application Ser. No. 61/192,142 filed Sep. 16, 2008, entitled "Small Watercraft Docking Apparatus To Facilitate Boarding And Disembarking", naming David Sturtevant as an inventor and which is incorporated herein by reference.

STATEMENT REGARDING FEDERALLY SPONSORED RESEARCH OR DEVELOPMENT

Not Applicable.

BACKGROUND OF THE INVENTION

This disclosure relates generally to docks and/or boatlifts for small watercraft, and in particular to such docks and/or lifts for use by manually or paddle powered boats, such as canoes, kayaks, etc.

Boat lifts for small watercraft, such as personal watercraft (PWC's), kayaks, canoes, etc. typically include a cradle for the watercraft which is bounded on at least two sides by decking. The boat lift, in turn, is often part of a docking system, which provides lifts for several watercraft. A popular boat lift is sold by EZ Dock, Inc. under the name EZ Port® and EZ Port Max®. However, those who have impaired leg function or are wheel-chair bound such boat lifts find it difficult to board and disembark watercraft when docked in such boat lifts. Additionally, boatlifts, such as the EZ Port and EZ Port Max rely on power from a motor to propel the watercraft onto the boat lift. It is difficult to product sufficient energy in manually powered (or rowed) watercraft, such as canoes, kayaks, etc. to propel the canoe, kayak, etc. onto the boat lift. Thus, the boater will need to exit or disembark the boat at the dock, and then maneuver the boat around the dock to the boat lift and pull the boat onto the boat lift.

It would therefore be desirable to provide a boat lift for small watercraft which would make it easier for those with impaired leg function or otherwise use a wheel chair to board and disembark from small watercraft. It would also be desirable to provide a boat lift in which oar powered or rowed boats (such as canoes, kayaks, etc.) can be driven or propelled onto a boat lift.

BRIEF SUMMARY OF THE INVENTION

A boatlift for manually powered (i.e., paddle or oar powered) watercraft is provided. The boatlift is a floating boatlift which comprises an elongate cradle, decking on opposite sides of the cradle, an entrance ramp to the cradle, a first guide rail positioned on one side of the cradle and a second guide rail positioned on a second side of the cradle opposite the first side. The first and second guide rails each comprise an approach portion which extends rearwardly of the boatlift ramp and a boatlift portion extending along the boatlift cradle. Each of the guide rails further comprises at least one grab bar extending generally horizontally along the rail. The at least one grab bar is positioned on the guide rail to be at a height where a boater sitting in a paddle or oar powered watercraft could reach the grab bar. Additionally, the first and second guide rails are spaced apart from each other a distance sufficient to allow a paddle or oar powered boat to pass between the rails, yet allow a boater to simultaneously grab the grab bars of both the first and second guide rails so that the boater can utilize the grab rails to move the boat between the guide rails. The first guide rail is an inside guide rail and the second guide rail is an outside guide rail. The outside guide rail is longer than the inside guide rail. Specifically, the boat lift portion of the inside guide rail has an end spaced rearwardly of an end of the boatlift, whereas, the outside guide rail has an end which is substantially even with the forward end of the boat lift.

In an illustrative embodiment, the guide rails each comprise an upper grab bar and a lower grab bar. The lower grab bar extends at least the length of the approach portion of the guide rails, and can extend to the end of the boatlift ramp (i.e., where the ramp and the cradle meet). The upper grab bar extends at least the length of the boatlift portion of the guide rails, and can extend substantially the length of the guide rail.

The boatlift can further include a barrier rail which is associated with the outside guide rail. The barrier rail comprises a horizontal bar spaced above the top bar of the guide rail, and can be mounted to the boatlift decking or to the outside guide rail. If the barrier rail is mounted to the outside guide rail, then the horizontal bar of the barrier rail is higher than it is if the barrier rail is mounted to the boatlift decking. The barrier rail can be independent of or integral with the guide rail.

The boatlift can also be provided with an entrance/exit assist member located proximate a forward end of one of the guide rails. The entrance/exit assist member comprises a pair of opposed legs extending upwardly on opposite sides of the boatlift cradle and a cross-member extending between the legs and over the cradle. The legs are of sufficient height such that a paddle or oar powered watercraft can pass under the cross-member, and whereby the cross-member is at a height to be reachable by a boater sitting in the watercraft. In addition, the dock to which the boatlift is adjacent can include at least one bench. The bench is positioned to be adjacent the assist member and extends generally perpendicularly to the boatlift. The bench extends from the dock and over an edge of the dock such that a portion of the bench extends over the boatlift cradle. Hence, a boater can sit at the far end of the bench and be positioned over the watercraft. The boater can then use the assist member to help lower himself/herself into the watercraft.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
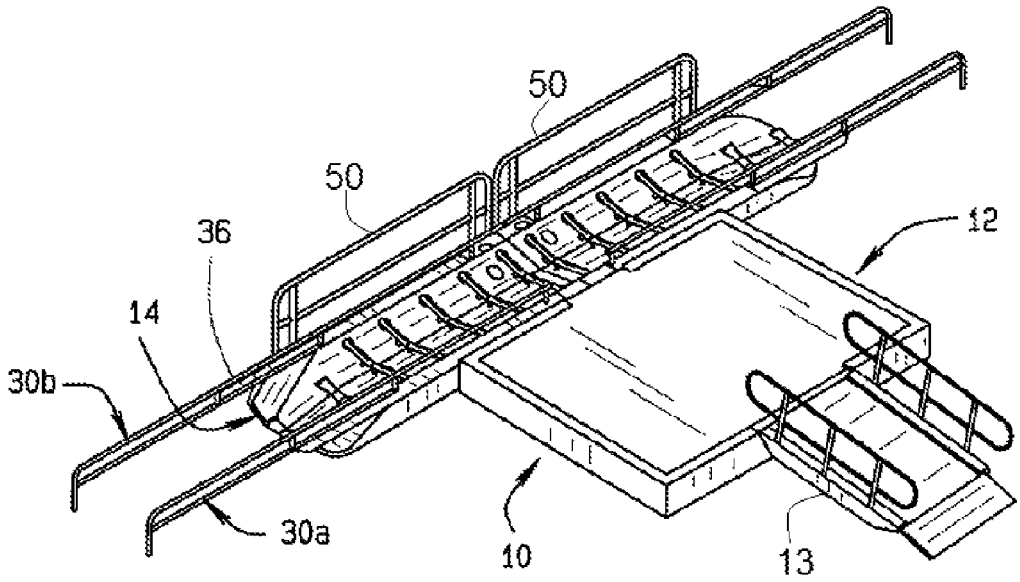
FIG. 1 is a perspective view of a boat lift provided with an illustrative guide rail system.

The following detailed description illustrates the invention by way of example and not by way of limitation. This description will clearly enable one skilled in the art to make and use the claimed invention, and describes several embodiments, adaptations, variations, alternatives and uses of the claimed invention, including what we presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

A dock system 10 for small watercraft includes a dock 12 and a boat lift 14. The dock 12 can be a floating dock, such as sold by EZ Dock, and which is comprised of a plurality of dock sections 12*a* (FIG. 2) which are connected together to form a dock of a desired shape and size. Preferably, the dock system 10 is provided with a gang plank or ramp 13 to facilitate entry onto and exit from the dock 12. A transition member 15 can be provided between the gang plank 13 and the dock 12. Such a dock can be made, for example, in accordance with U.S. Pat. Nos. 5,281,055 and 7,243,608 which are incorporated herein by reference.

Figure 3:
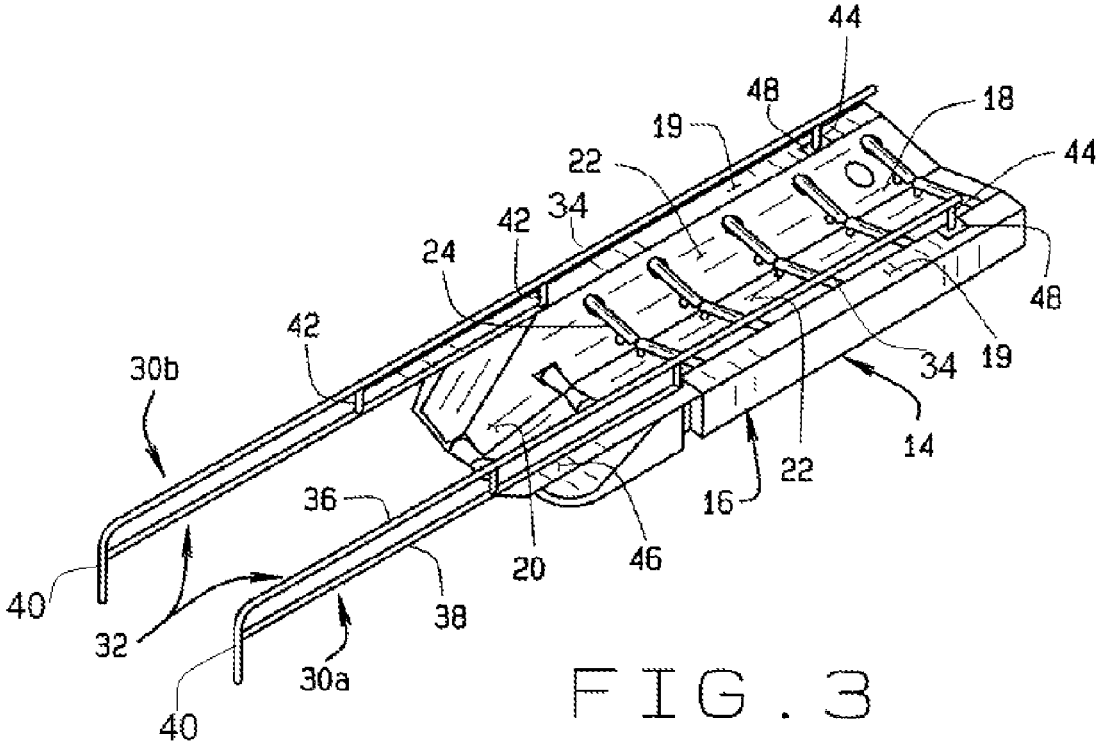
FIG. 3 is a perspective view of one illustrative embodiment of the guide rail system.

The boat lift 14 is secured to dock 12, in accordance with the docking system from which the dock 10 is made. With reference to FIG. 3, the boat lift 14 comprises a body 16 having a boat cradle 18 which, as shown, extends the length of the boat lift. A deck 19 extends along the outer edge of the cradle 18 on either side of the cradle 18. The boat lift is preferably a boat lift, such as described in US Pub. No. 20090044740, which is incorporated herein by reference, or which is sold by EZ Dock, Inc. under the name EZ Port Max. An entrance ramp 20 is at one end of the cradle. The cradle 18 has a pair of opposed, inwardly sloping walls 22 with rollers 24 positioned along each wall. The rollers can comprise elongate cylinders, as seem in FIG. 3, which extend transversely along the sloping walls 22 of the boat lift cradle 18. These rollers 24 have inner ends that are proximate the center of the cradle, but which are spaced from each other a sufficient distance to enable the rollers to rotate about an axis. Alternatively, the rollers 24 can be football or torpedo-shaped, such as described in US Pub. No. 20090044739, which is incorporated herein by reference.

The boat lift 14 is provided with guide rails 30*a,b* on either side of the cradle 18. The guide rails 30*a,b* are substantially the same. However, as will become apparent, the guide rail 30*b* is slightly longer than the guide rail 30*a*. The guide rail 30*b* can thus be considered an "outside" guide rail which is positioned on the far side of the boat lift 14 from the dock 12; and the guide rail 30*a* can be considered an "inside" guide rail which is on the dock side of the boat lift 14. Although the guide rails 30*a,b* are shown mounted on the right and left sides of the boatlift, respectively (with reference to FIG. 3), the guide rails 30*a,b* could alternatively be mounted on the left and right sides, respectively of the boatlift. The respective placement of the guide rails 30*a,b* depends on which way the boatlift is "facing" or which side of the boatlift is adjacent the dock 12.

The guide rails 30*a,b* are longer than the boat lift 14, and include an approach portion 32 in front of the boat lift ramp 20, and a boat lift section 34 which extends along the boat lift 14. As seen, the approach portion 32 of the guide rails 30*a,b* extend rearwardly of the boat lift ramp 20, such that a back end of the guide rails 30*a,b* is spaced from the back end of the ramp 20. Hence, the approach portions 32 of the two guide rails 30*a,b* define an approach lane which is at least as wide as the cradle 18 of the boat lift, into which a boater can direct a manually powered watercraft. In the outside guide rail 30*b*, the boat lift section 34 of the guide rail extends substantially to the end of the boat lift. In inside guide rail 30*a*, on the other hand, the boat lift section 34 ends short of the end of the boat lift. As seen in FIG. 1, when two boat lifts are connected end-to-end, the shorter inside guide rails provide an pass-through area from the dock 12 through which boaters can pass to access to watercraft.

Figure 2:
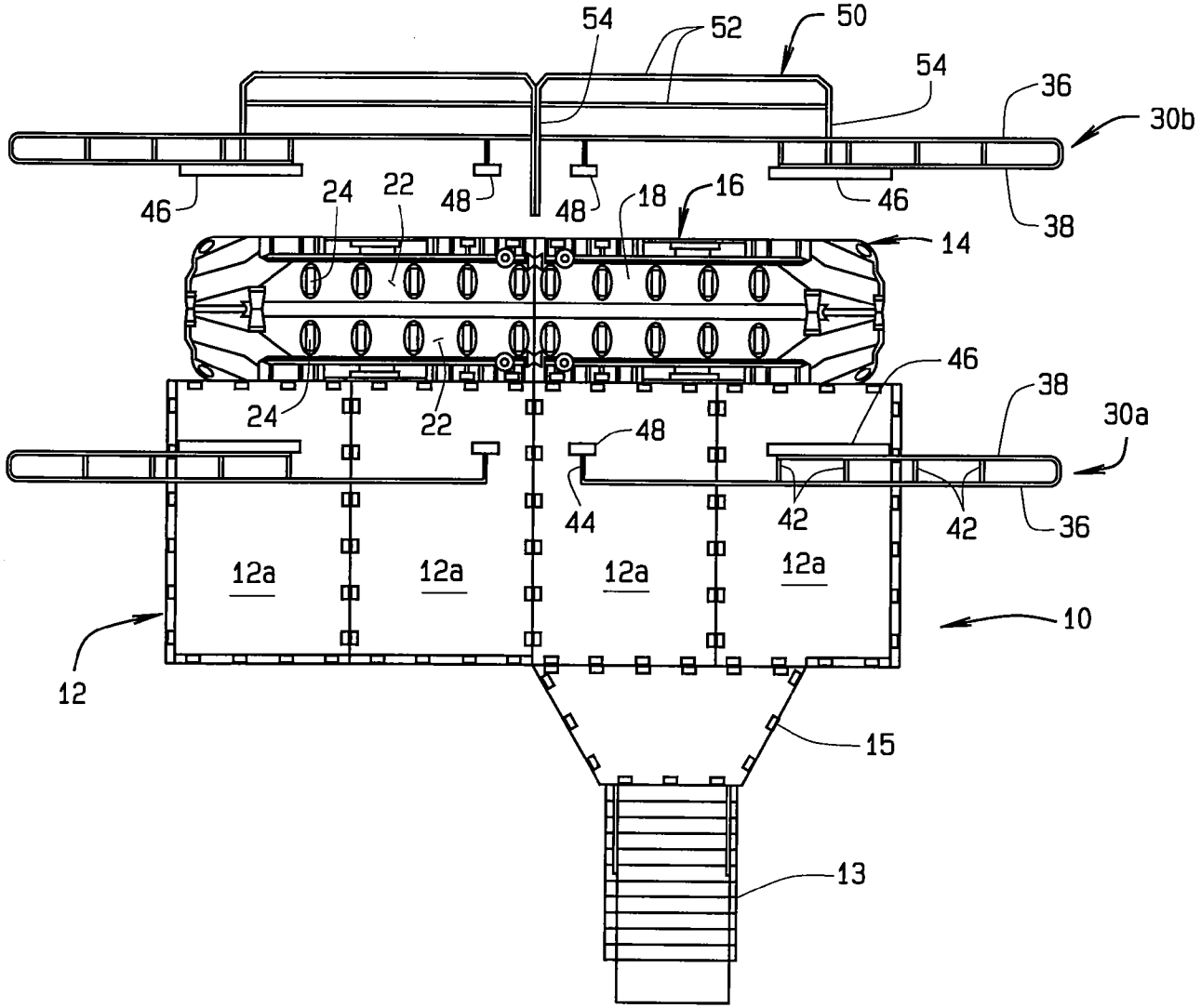
FIG. 2 is a schematic drawing of guide rails of the guide rail system with a plan view of a boat lift and dock.

The guide rails each include a top grab bar 36 which extends substantially the full length of the guide rail 30 and a lower grab bar 38 which extends the length of the approach section 32 of the guide rails. The lower grab bar 38 is essentially level with the boat lift deck 19. The guide rail additionally can include a front pole 40 at the front end of the guide rail 30 to which both the upper and lower grab bars are connected. Alternatively, as seen in FIG. 2, the front end of the guide rail can simply be closed by a section of the bar. In this instance, the grab bars 36 and 38 can be formed from a single long section of tubing which is bent to form the two grab bars. Connector posts 42 extend between the upper and lower grab bars 36,38, and an end post 44 is positioned near the end of the guide rail. On the inside guide rail 30*a*, the top grab bar 36 ends at the end post 44, whereas, on the outside guide rail 30*b*, the top grab bar extends beyond the end post 44. Lastly, the guide rails 30*a,b* include a mounting plate 46 which extends between the two connector posts 42, and a mounting plate 48 at the bottom of the post 44 to facilitate mounting of the guide rail to the boat lift 14. The mounting plates 46 and 48 are generally perpendicular to the posts 42 and 44, such that when the mounting plates are secured to the deck portion 19 of the boatlift 14, the guide rails 30*a,b* will be generally perpendicular to the boatlift (and will be generally vertical).

Figure 4A:
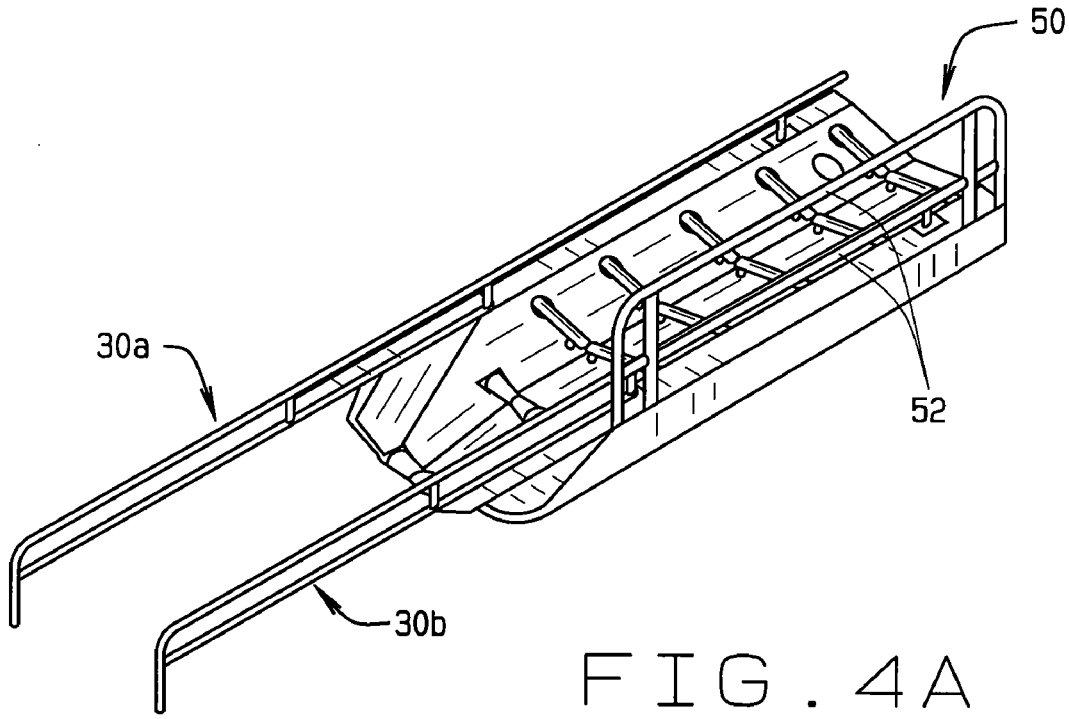
FIGS. 4*a,b* are perspective views of the guide rail system provided with barrier rails, the two figures showing the barrier rail mounted in two different positions relative to the guide rails.
Figure 4B:
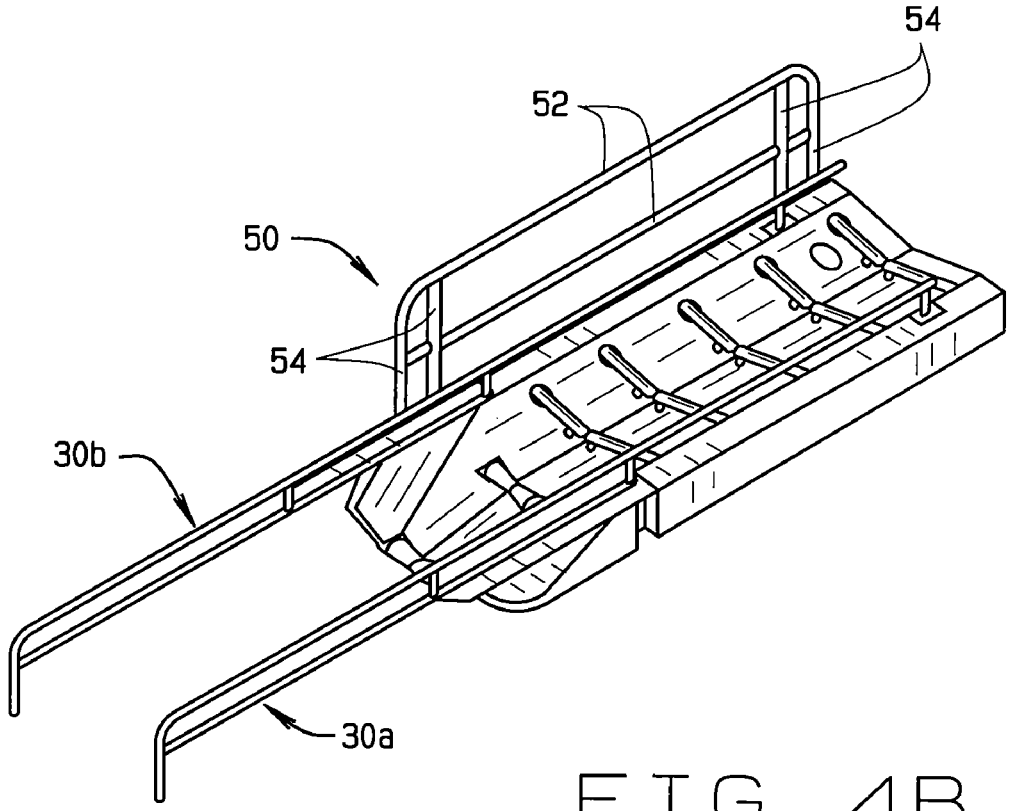

As shown in FIGS. 1 and 4*a,b*, a barrier rail 50 can be provided. The barrier rail 50 includes a pair of vertically spaced apart, horizontally extending bars 52 which are connected to, at their opposite ends, by vertical posts 54. The barrier rail 50 extends the length of the boatlift cradle 18 (or generally from the end of the boatlift ramp 20 to the opposite end of the boatlift 14. As shown in FIG. 4*a*, the barrier rail 50 can be mounted directly to the boat lift, in which case, the barrier rail lower bar is generally level with the upper grab bar of the guide rail approach portion. In this instance, this lower bar of the barrier rail could operate as a continuation of the lower grab bar. Alternatively, as shown in FIG. 4*b*, the barrier rail can be mounted to the guide rail 30, such that the bottom of the vertical posts 54 of the barrier rail are approximately level with the top bar of the guide rail. Here, the barrier rail is described as being separate from the guide rail. However, the barrier rail could be formed with, or as a part of, the guide rail. As seen, the barrier rail is associated with the outside guiderail 30*b*.

Figure 5:
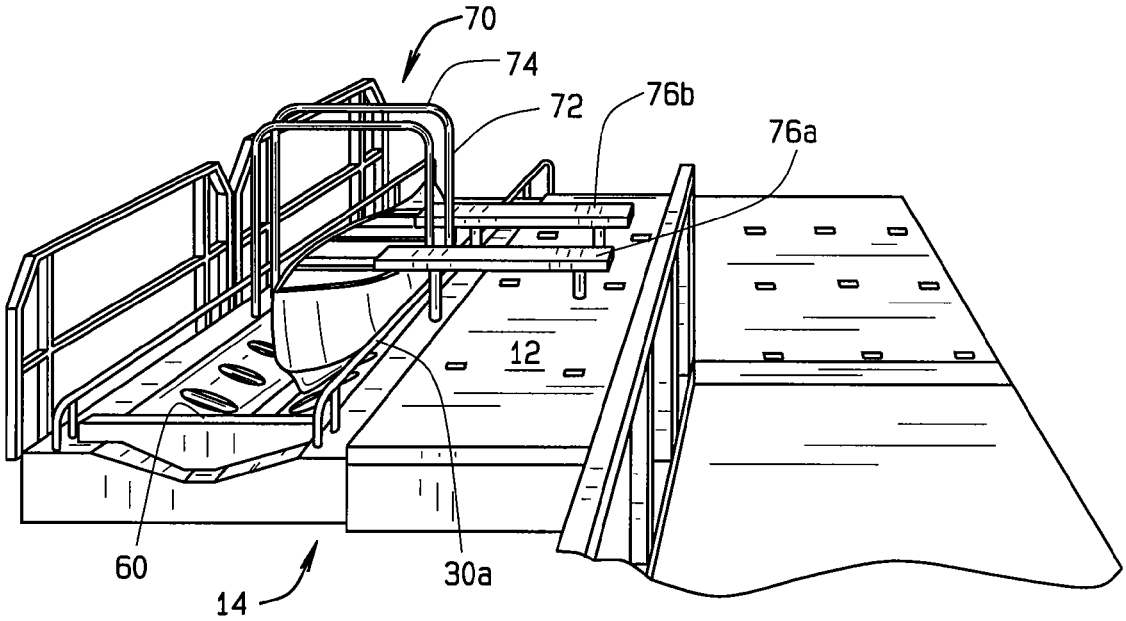
FIGS. 5 and 6 are front and side perspective views of the guide rail system provided with assist members to facilitate entry into and exit from small watercraft and benches on the dock to facilitate use of the assist members.

As shown in FIG. 1, two boat lifts can be connected in tandem to form a single boat lift that is open at both ends. In this instance, one end of the boat lift serves as an entrance, and the opposite end serves as an exit. Alternatively, if the boatlift does not include a ramp at its forward end, as seen in FIG. 5, the boatlift can be provided with a stop 60 (FIG. 5) to prevent the watercraft from being propelled forwardly off the end of the boatlift. The stop 60 can simply be a bar which extends across the forward end of the boatlift between the inside and outside guide rails 30*a,b*, as seen in FIG. 5. Alternatively, the stop 60 can comprise a bow stop, as disclosed in the above noted US Pub. No. 20090044740, which is incorporated herein by reference.

When the guide rails 30 are mounted to the boat lift 14, the lower grab bars 38 of the approach portion 32 are approximately at the level of the canoe, kayak, etc. so that they can easily be grasped by a boater sitting in the canoe, kayak, etc. when the boater is in the approach lane defined by the guide rails. Further, the spacing between two guide rails will allow the boat to pass between the rails 30, while allowing the boater to grab both rails at the same time. Hence, by grabbing the lower grab bars 38 of the approach portion of the guide rails 30, the boater can propel his/her boat forward with sufficient force to drive the watercraft onto the on-ramp of the boatlift. By grabbing a forward section of the grab bars 36, 38, the boater can continue to propel his/her boat along the boatlift until the watercraft (i.e., canoe, kayak, etc.) is fully on the boatlift. As can be appreciated, as the watercraft is propelled onto the boatlift, the level of the watercraft, and hence, the boater, will be raised. Hence, as the boater moves the watercraft along the boatlift, the boater can change from initially using the lower grab bars 38 to using the upper grab bars 36 of the guide rails 30. When a boater desires to launch the watercraft, the boater need only get into the watercraft, and using the guide rails 30*a,b*, propels the boat off the boatlift. In the embodiment of FIG. 1 (which has ramps at both ends of the boatlift) the boater can go forward, whereas in the embodiment of FIG. 5 (which has a stop extending across the forward end of the boatlift), the boater will need to go backwards to exit the boat lift. In either case, the rollers facilitate moving the watercraft along the boat lift, such that moving the watercraft along the boatlift is not unduly strenuous.

Figure 6:
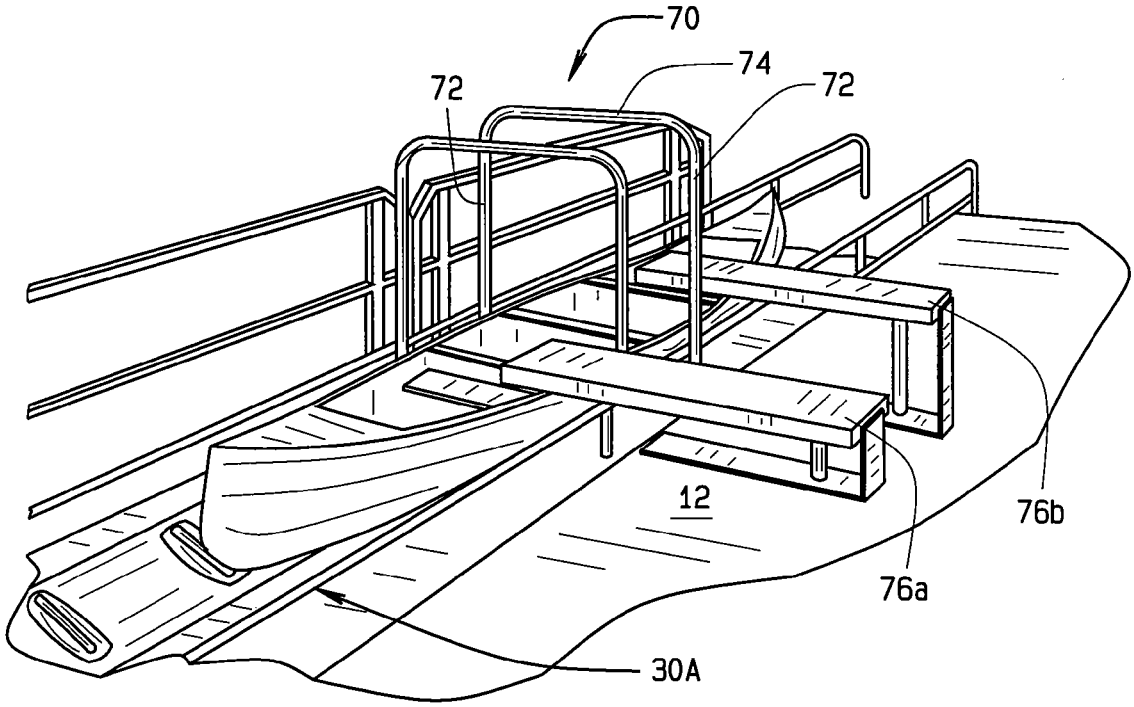

The embodiment of FIGS. 1-4*b* works well for able bodied boaters. However, it does not necessarily work well for boaters with impaired leg function, are in a wheel chair, or otherwise have difficulty in getting into and out of small watercraft. In FIGS. 5 and 6, the boatlift is provided with an entrance/exit assist member 70 comprised of vertical legs 72 and a cross-member 74 extending between the legs 72. The legs 72 extend upwardly from the boatlift on opposite sides of the boatlift cradle 18, and the cross-member 74 extends over the cradle 18. The assist member 70 is positioned at the end of the inside guide rail 30*a*. Thus, in FIGS. 5 and 6, where two boatlifts are interconnected, and the inside guide rails form a pass through area, the assist members 70 are positioned at this pass-through area. As seen, a boat can pass under the assist members 70. The assist members 70 are sized such that the cross-member 74 is at a height which will allow for a boater sitting on a bench in the boat to reach up and grab the cross-member 74.

The dock is further provided with a pair of benches 76*a,b* positioned adjacent the assist members 70. The benches 76*a,b* each extend across a portion of the dock 12 so that the benches can be used by people on the dock 12. In addition, the benches 76*a,b* extend past the edge of the dock and over the decking of the boatlift, such that the edge of the benches are over the gunwales of the boat. In FIGS. 5 and 6, the benches 76*a,b* are of different heights, with the bench 76*b* being higher than the bench 76*a*. This allows for the benches to accommodate people of different abilities. For example, one of the benches may be easier for someone in a wheelchair to use, while the other bench may be easier for someone who walks, but otherwise needs assistance in getting into and out of the watercraft.

To use the entry/exit assist, the boat is positioned at the pass-through between the inside guide rails 30*a* with the boat seats generally beneath the assist members 70. With the boat in position, a boater can seat himself/herself on one of the benches 76*a,b* and slide over to the edge of the bench. By holding on to the cross-member 74, the boater can lower himself/herself from the bench 76*a,b* to the boat seat.

As various changes could be made in the above constructions without departing from the scope of the invention, it is intended that all matter contained in the above description or shown in the accompanying drawings shall be interpreted as illustrative and not in a limiting sense. For example, although the inside guide rail 30*a* is described to be mounted or secured to the boatlift, the inside guide rail 30*a* could be secured to the edge of the dock 12. Although the guide rails include upper and lower grab bars, the guide rails could each be provided with a single grab bar. In this case, the single grab bar would preferably be contoured, such that the section of the grab bar in the approach portion of the guide rail is below the section of the grab bar in the boatlift portion of the guide rail. These examples are merely illustrative.

The invention claimed is:

1. A boatlift for paddle or oar powered watercraft, the boatlift comprising a boatlift body, a first guide rail and a second guide rail, said boatlift body defining a first end, a second end opposite said first end, a first side, and a second side opposite said first side; said first and second sides extending from said first end to said second end of said boatlift body, an elongate watercraft-receiving cradle extending from said first end of said boatlift body toward said second end of said boatlift body, decking on opposite sides of said watercraft-receiving cradle, and an entrance ramp to said watercraft-receiving cradle, said entrance ramp being positioned at said first end of said boatlift body; said first guide rail being positioned adjacent to said first side of said watercraft-receiving cradle and said second guide rail being positioned adjacent to said second side of said watercraft-receiving cradle; said first and second guide rails each comprising an approach portion and a boatlift portion; said approach portions of said guide rails extending from said first end of said boatlift body in a direction away from said second end of said boatlift body to extend over water when said boatlift is positioned in water such that said approach portions of said guide rails have an end which is spaced rearwardly from said first end of said boatlift body such that the approach portions of the guide rails in combination define an approach lane having an approach entrance spaced rearwardly from said entrance ramp and said first end of said boatlift body; said approach lane extending at least from said approach entrance to the entrance ramp of the boatlift body; said boatlift portion of said guide rails extending forwardly along said watercraft-receiving cradle toward said second end of said boatlift body; each said guide rail further comprising at least one grab bar extending generally horizontally along said rail; said at least one grab bar being positioned on said guide rail to be at a height where a boater sitting in a paddle or oar powered watercraft could reach said grab bar; said first and second guide rails being spaced apart from each other a distance sufficient to allow a paddle or oar powered boat to pass therebetween, yet allowing a boater to simultaneously grab the grab bars of both said first and second guide rails.

2. The boatlift of claim 1 wherein said first guide rail is an inside guide rail and said second guide rail is an outside guide rail; said outside guide rail being longer than said inside guide rail; the boatlift portion of said inside guide rail having an end spaced rearwardly of said second end of said boatlift body and said outside guide rail having an end which is substantially even with said second end of said boatlift body.

3. The boatlift of claim 1 wherein said at least one grab bar comprises an upper grab bar and a lower grab bar; said lower grab bar extending at least the length of said approach portion of said guide rails; and said upper grab bar extending at least the length of said boatlift portion of said guide rails.

4. The boatlift of claim 3 wherein said lower grab bar extends from a rearward end of said guide rail to an approximate end of said entrance ramp of said boatlift body.

5. The boatlift of claim 4 wherein said upper grab bar extends substantially the length of said guide rail.

6. The boatlift of claim 3 wherein said upper grab bar extends substantially the length of said guide rail.

7. The boatlift of claim 3 further comprising a barrier rail; said barrier rail comprising a horizontal bar spaced above said upper grab bar of one of said first and second said guide rails.

8. The boatlift of claim 7 wherein said barrier rail is mounted to or integral with said one of said first and second guide rails.

9. A boatlift for paddle or oar powered watercraft, the boatlift comprising a body, a first guide rail and a second guide rail, said body having an elongate watercraft-receiving cradle, decking on opposite sides of said watercraft-receiving cradle, and an entrance ramp to said watercraft-receiving cradle; said first guide rail being positioned on one side of said cradle and said second guide rail being positioned on a second side of watercraft-receiving cradle opposite said first side; said first and second guide rails each comprising an approach portion extending rearwardly of said entrance ramp of said boatlift body and a boatlift portion extending along said watercraft-receiving cradle; said approach portions of said guide rails having a back end which is spaced rearwardly from a back end of said entrance ramp such that the approach portions of the guide rails in combination define an approach lane leading up to the ramp of the boatlift body; each said guide rail further comprising at least one grab bar extending generally horizontally along said rail; said at least one grab bar being positioned on said guide rail to be at a height where a boater sitting in a paddle or oar powered watercraft could reach said grab bar; said first and second guide rails being spaced apart from each other a distance sufficient to allow a paddle or oar powered boat to pass therebetween, yet allowing a boater to simultaneously grab the grab bars of both said first and second guide rails; said boatlift further including an entrance/exit assist member located proximate a forward end of one of said guide rails; said entrance/exit assist member comprising a pair of opposed legs extending upwardly on opposite sides of said watercraft-receiving cradle, and a cross-member extending between said legs and over said cradle; said legs being of sufficient height such that a paddle or oar powered watercraft can pass under said cross-member, and whereby said cross-member is at a height to be reachable by a boater sitting in said watercraft.

10. A docking system comprising a dock and a boatlift adjacent said dock; the boatlift comprising a boatlift body, a first guide rail and a second guide rail; said boatlift body defining a first end, a second end opposite said first end, a first side, and a second side opposite said first side; said first and second sides extending from said first end to said second end of said boatlift body, an elongate watercraft-receiving cradle extending from said first end of said boatlift body toward said second end of said boatlift body, decking on opposite sides of said watercraft-receiving cradle, and an entrance ramp to said cradle, said entrance ramp being positioned proximate said first end of said boatlift body; said first guide rail positioned adjacent to said first side of said watercraft-receiving cradle and said second guide rail positioned adjacent to said second side of said watercraft-receiving cradle; said first and second guide rails each comprising an approach portion and a boatlift portion; said approach portions of said guide rails extending from said first end of said boatlift body in a direction away from said second end of said boatlift body to extend over water when said boatlift is positioned in water such that said approach portions of said guide rails have an end which is spaced rearwardly from said first end of said boatlift body such that the approach portions of the guide rails in combination define an approach lane having an approach entrance spaced rearwardly from said boatlift body and said first end of said boatlift body; said approach lane extending at least from said approach entrance to the entrance ramp of the boatlift body; said boatlift portion of said guide rails extending forwardly adjacent said side edges of said boatlift body toward said second end of said boatlift body; each said guide rail further comprising at least one grab bar extending generally horizontally along said guide rail; said at least one grab bar being positioned on said guide rail to be at a height where a boater sitting in a paddle or oar powered watercraft could reach said at least one grab bar; said first and second guide rails being spaced apart from each other a distance sufficient to allow a paddle or oar powered boat to pass therebetween, yet allowing a boater to simultaneously grab the at least one grab bar of both said first and second guide rails.

11. The docking system of claim 10 wherein said first guide rail is an inside guide rail and said second guide rail is an outside guide rail; said outside guide rail being longer than said inside guide rail; the boatlift portion of said inside guide rail having an end spaced rearwardly of said second end of said boatlift body and said outside guide rail having an end which is substantially even with said second end of said boatlift body.

12. The docking system of claim 10 wherein said at least one grab bar comprises an upper grab bar and a lower grab bar; said lower grab bar extending at least the length of said approach portion of said guide rails; and said upper grab bar extending at least the length of said boatlift portion of said guide rails.

13. The docking system of claim 12 wherein said lower grab bar extends from a rearward end of said guide rail to an approximate end of said entrance ramp of said boatlift.

14. The docking system of claim 12 wherein said upper grab bar extends substantially the length of said guide rail.

15. The docking system of claim 10 including an entrance/exit assist member located proximate a forward end of one of said guide rails; said entrance/exit assist member comprising a pair of opposed legs extending upwardly on opposite sides of said watercraft-receiving cradle of said boatlift, and a cross-member extending between said legs and over said watercraft-receiving cradle; said legs being of sufficient height such that a paddle or oar powered watercraft can pass under said cross-member, and whereby said cross-member is at a height to be reachable by a boater sitting in said watercraft.

16. The docking system of claim 15 wherein said dock includes at least one bench; said bench extending generally perpendicularly to said boatlift; said bench extending from said dock and over an edge of said dock such that a portion of said bench extends over said watercraft-receiving cradle of said boatlift.

17. A dock system comprising:

a boatlift body, the boatlift body comprising an elongate watercraft-receiving cradle, decking on opposite sides of said watercraft-receiving cradle, and an entrance ramp to said cradle; and an entrance/exit assist member said entrance/exit assist member comprising a first leg extending upwardly from said decking on one side of said watercraft-receiving cradle, a second leg extending upwardly from said decking on a side of said watercraft-receiving cradle opposite said first leg, and a cross-member extending between said legs and over said cradle; said legs being of sufficient height such that a paddle or oar powered watercraft can pass under said cross-member, and whereby said cross-member is at a height to be reachable by a boater sitting in said watercraft; and a dock; said boatlift being secured to said dock; said dock including at least one bench; said bench extending generally perpendicularly to said boatlift; said bench extending from said dock and over an edge of said dock such that a portion of said bench extends over said watercraft-receiving cradle.

18. The dock system of claim 17 wherein said entrance/exist assist member is a first entrance/exist assist member; said dock system further including a second entrance/exist assist member spaced forwardly from said first entrance/exist assist member; said second entrance/exist assist member comprising a first leg extending upwardly from said decking on one side of said watercraft-receiving cradle, a second leg extending upwardly from said decking on a side of said watercraft-receiving cradle opposite said first leg, and a cross-member extending between said legs and over said watercraft-receiving cradle; said legs being of sufficient height such that a paddle or oar powered watercraft can pass under said cross-member, and whereby said cross-member is at a height to be reachable by a boater sitting in said watercraft.

* * * * *

UNITED STATES PATENT AND TRADEMARK OFFICE

CERTIFICATE OF CORRECTION

PATENT NO. : 8,256,366 B2
APPLICATION NO. : 12/557278
DATED : September 4, 2012
INVENTOR(S) : Dustin Imel and David J. Sturtevant It is certified that error appears in the above-identified patent and that said Letters Patent is hereby corrected as shown below:

In column 3, line 37, after the word "as" and before the word "in", the word should be spelled --seen--;

In Claim 9, column 7, line 22, after the word "of" and before the words "watercraft-receiving", the word --said-- should be inserted.

Signed and Sealed this
Sixteenth Day of October, 2012

David J. Kappos

David J. Kappos
*Director of the United States Patent and Trademark Office*